US006694935B2

(12) United States Patent
Miyazato et al.

(10) Patent No.: US 6,694,935 B2
(45) Date of Patent: Feb. 24, 2004

(54) VALVE MECHANISM OF INTERNAL COMBUSTION ENGINE

(75) Inventors: Yoshiaki Miyazato, Kanagawa (JP); Makoto Nakamura, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/455,360

(22) Filed: Jun. 6, 2003

(65) Prior Publication Data

US 2003/0226531 A1 Dec. 11, 2003

(30) Foreign Application Priority Data

Jun. 7, 2002 (JP) ..... 2002-166414
Dec. 12, 2002 (JP) ..... 2002-360363

(51) Int. Cl.[7] ..... F01L 1/34

(52) U.S. Cl. ..... 123/90.16; 123/90.15; 123/90.17; 123/90.31

(58) Field of Search ..... 123/90.16, 90.15, 123/90.17, 90.27, 90.31, 90.39, 90.44, 90.6; 74/567, 568 R

(56) References Cited

U.S. PATENT DOCUMENTS 6,418,898 B2 * 7/2002 Tanaka et al. ..... 123/90.4
6,561,148 B2 * 5/2003 Moteki et al. ..... 123/90.16

FOREIGN PATENT DOCUMENTS

JP 2001-55915 A 2/2001

* cited by examiner

*Primary Examiner*—Thomas Denion
*Assistant Examiner*—Kyle Riddle
(74) *Attorney, Agent, or Firm*—Foley & Lardner

(57) ABSTRACT

A drive shaft is synchronously rotated with a crankshaft of an internal combustion engine. A cylindrical hollow cam shaft is rotatably disposed about the drive shaft keeping a first cylindrical clearance therebetween. The cam shaft is formed with at least one cam that actuates an engine valve for opening and closing the same. A bearing bears a given portion of the cam shaft keeping a second cylindrical clearance therebetween. A movement transmitting mechanism transmits a torque of the drive shaft to the cam shaft while converting a rotation movement of the drive shaft to a swing movement of the cam shaft. The thickness of the first cylindrical clearance is smaller than that of the second cylindrical clearance.

15 Claims, 9 Drawing Sheets

VALVE MECHANISM OF INTERNAL COMBUSTION ENGINE

BACKGROUND OF THE INVENTION

1. Field of Invention

The present invention relates in general to valve mechanisms of an internal combustion engine, and more particularly to the valve mechanisms of a type that varies a valve lift characteristic of an intake or exhaust valve of the engine in accordance with an operation condition of the engine.

2. Description of Related Art

Hitherto, various valve mechanisms of an internal combustion engine have been proposed and put into practical use. One of them is disclosed in Japanese Laid-open Patent Application (Tokkai) 2001-55915. For clarifying the present invention, the valve mechanism of the application will be briefly described in the following.

The valve mechanism is incorporated with an internal combustion engine of a type having two intake valves for each cylinder, and comprises a drive shaft driven synchronously by a crankshaft of the engine, an eccentric drive cam mounted to the drive shaft to rotate therewith, and a cylindrical hollow cam shaft concentrically disposed about the drive shaft. To this cam shaft, there are mounted a pair of swing cams for the intake valves of the engine. To the swing cams, there is transmitted a rotation force (viz., torque) of the eccentric drive cam through a movement transmitting mechanism, so that the intake valves are actuated to open and close through respective valve lifters. The cam shaft is rotatably supported, at a journal portion thereof provided between the two swing cams, by a cam shaft bearing portion which includes a shaft bearing recess formed in an upper surface of a cylinder head of the engine and a bearing bracket.

The movement transmitting mechanism comprises a rocker arm that is rotatably held by a control shaft through a control cam, a link arm that has one end rotatably disposed about the eccentric drive cam and the other end pivotally connected to an end of the rocker arm, and a link rod that has one end pivotally connected to the other end of the rocker arm and the other end pivotally connected to a leading end portion of a cam nose portion of one of the swing cams.

To a cylindrical outer surface of the control shaft, there is mounted an eccentric control cam to rotate therewith. This eccentric control cam is rotatably received in a holding bore formed in a generally intermediate portion of the rocker arm, so that a fulcrum of the rocker arm is displaced in accordance with rotation of the eccentric control cam. With the displacement of the fulcrum, the contact point of a cam surface of each swing cam relative to an upper surface of the valve lifter moves thereby to continuously vary the lift degree of each intake valve.

By varying or adjusting the valve lift characteristic in accordance with an operation condition of the engine, fuel consumption, output performance and the like are improved.

SUMMARY OF THE INVENTION

However, due to an inherent construction, the above-mentioned known valve mechanism tends to exhibit a non-negligible inclination or lurching of the cam shaft particularly when the intake valves are under their opening stroke. As is known, such inclination brings about a development of uneven wearing of bearing portions of the cam shaft.

Accordingly, it is an object of the present invention to provide a valve mechanism of an internal combustion engine, which is free of the above-mentioned drawback.

According a first aspect of the present invention, there is provided a valve mechanism of an internal combustion engine, which comprises a drive shaft synchronously rotated with a crankshaft of the engine; a supporting shaft; a cylindrical hollow cam shaft rotatably disposed about the supporting shaft keeping a first cylindrical clearance therebetween, the cam shaft being formed with at least one cam that actuates an engine valve for opening and closing the same; a bearing which bears a given portion of the cam shaft keeping a second cylindrical clearance therebetween; and a movement transmitting mechanism which transmits a torque of the drive shaft to the cam shaft while converting a rotation movement of the drive shaft to a swing movement of the cam shaft, the thickness of the first cylindrical clearance being smaller than that of the second cylindrical clearance.

According to a second aspect of the present invention, there is provided a valve mechanism of an internal combustion engine which has two engine valves for each cylinder which are biased in a closing direction by valve springs, the valve mechanism comprising a supporting shaft; a swing member having a through bore, the swing member being swingably disposed on the supporting shaft having the supporting shaft received in the through bore, the swing member operating the engine valves to open against a biasing force of the valve springs when swung; and a drive mechanism that applies a drive force to the swing member to effect the swing movement against the biasing force of the valve springs, the drive mechanism being constructed to apply the drive force to one end portion of the swing member with respect to an axial direction of supporting shaft, wherein, when the engine valves are maximally opened by the swing member, a distance from a second diametrically center position of the through bore of the swing member to a head member of the corresponding engine valve is longer than a distance from a first diametrically center position of the through bore of the swing member to a head member of the corresponding engine valve, the first diametrically center position being in the vicinity of the one end portion of the swing member.

According to a third aspect of the present invention, there is provided a valve mechanism of an internal combustion engine having first and second engine valves for each cylinder, which comprises a drive shaft rotated synchronously together with a crankshaft of the engine; a cylindrical hollow cam shaft rotatably disposed about the drive shaft keeping a first cylindrical clearance therebetween, the cam shaft being formed with first and second cams that respectively actuate the first and second engine valves for opening and closing the same; a bearing which bears a given portion of the cam shaft keeping a second cylindrical clearance therebetween, the given portion being positioned between the first and second cams; and a movement transmitting mechanism which transmits a torque of the drive shaft to the cam shaft while converting a rotation movement of the drive shaft to a swing movement of the cam shaft, the movement transmitting mechanism being arranged to apply the torque to one axial end of the cam shaft where the first cam is provided, wherein the thickness of the first cylindrical clearance is smaller than that of the second cylindrical clearance.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, six embodiments, viz., valve mechanisms 100, 200, 300, 400, 500 and 600 of the present invention will be described in detail with reference to the accompanying drawings.

Figure 1:
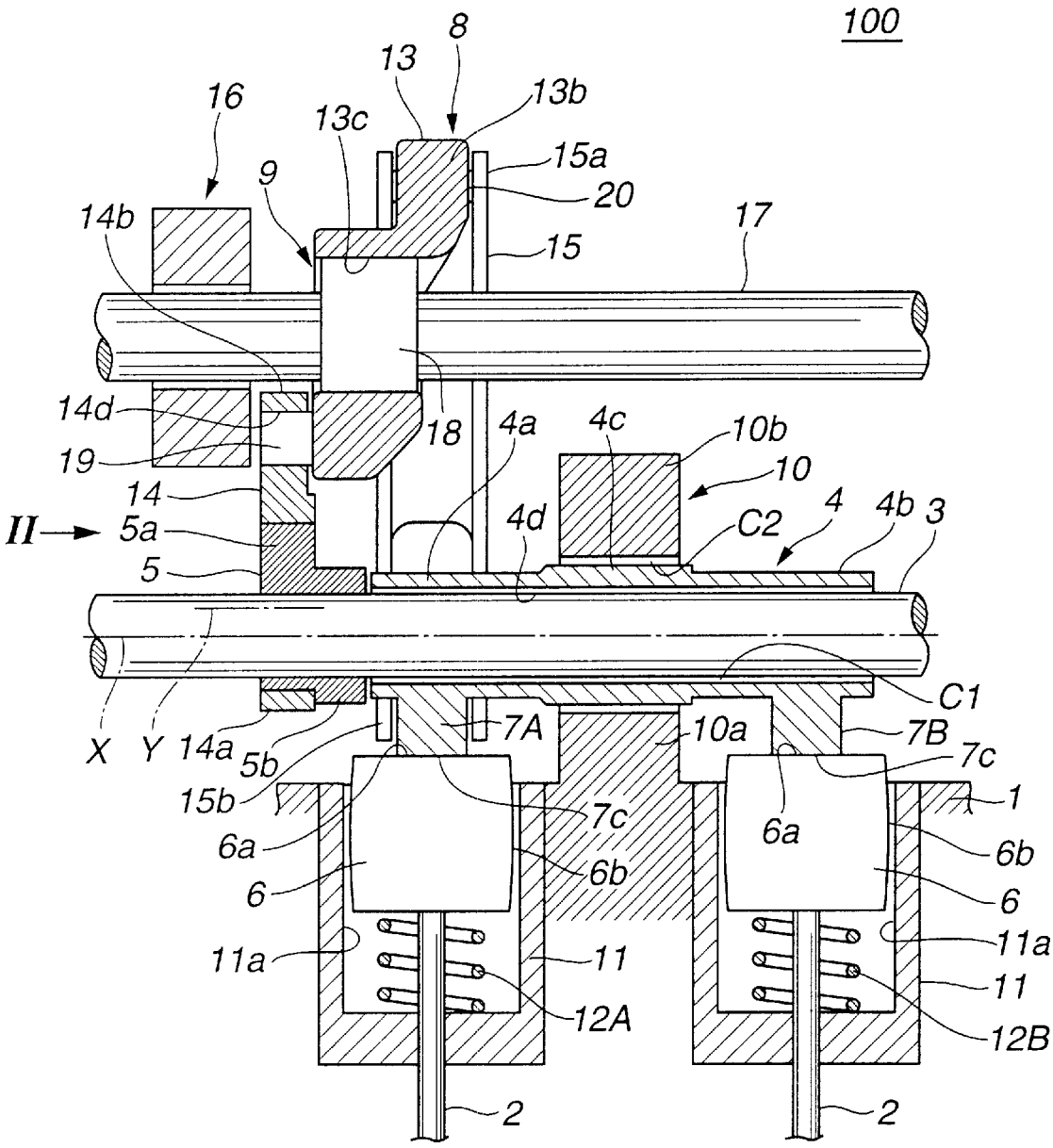
FIG. 1 is a sectional view of an essential portion of a first embodiment of the present invention.
Figure 2:
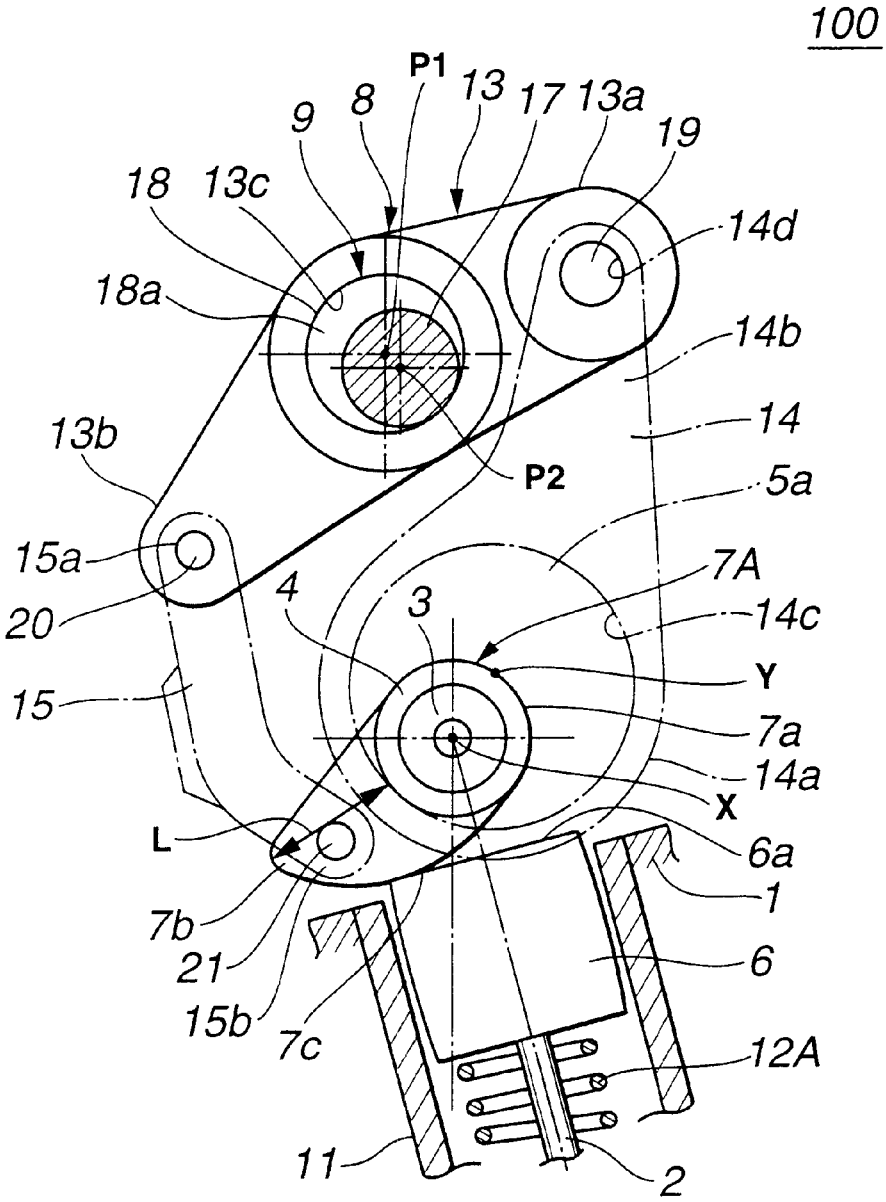
FIG. 2 is a sectional view taken from the direction of arrow II of FIG. 1.
Figure 3:
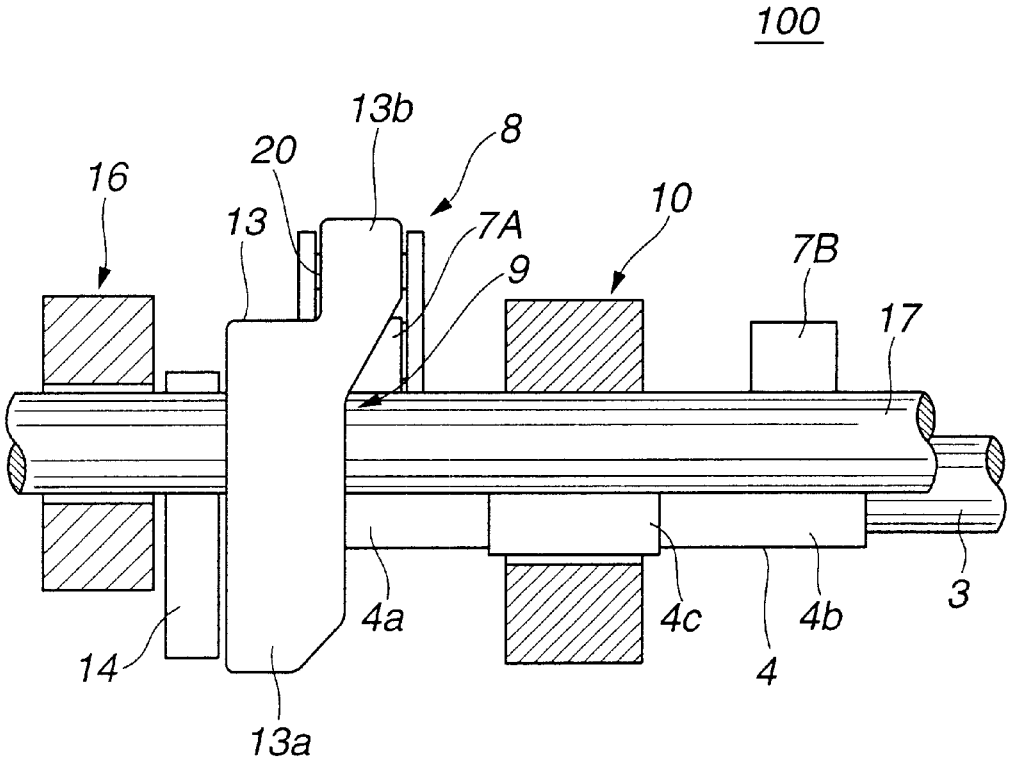
FIG. 3 is a plan view of the essential portion of the first embodiment.

Referring to FIGS. 1, 2 and 3, particularly FIG. 1 of the drawings, there is shown but partially a valve mechanism 100 of a first embodiment of the present invention.

As will become apparent from the following, valve mechanism 100 of the first embodiment is constructed to incorporate with an internal combustion engine of a type having two intake valves for each cylinder.

As shown in FIG. 1, a cylinder head 1 of the engine has two intake valves 2 and 2 for each cylinder, which are slidably held through valve guides (not shown). A drive shaft 3 extends along a longitudinal axis of the engine. A hollow cam shaft 4 is coaxially and rotatably disposed about drive shaft 3. A cylindrical outer surface of drive shaft 3 is denoted by 3*a*. A drive cam 5 is fixed to drive shaft 3 at a position near an end of cam shaft 4. Cam shaft 4 has at both end portions 4*a* and 4*b* thereof respective swing cams 7A and 7B which are integral thereto. Swing cams 7A and 7B are in contact with valve lifters 6 and 6 arranged at upper ends of intake valves 2 and 2, so that when swing cams 7A and 7B are swung together with cam shaft 4, intake valves 2 and 2 are pushed in an opening direction. Between drive cam 5 and cam shaft 4, there is arranged a movement transmitting mechanism 8 which converts a rotation movement of drive shaft 3 to a swing movement of cam shaft 4 and that that of swing cams 7A and 7B for opening intake valves 2 and 2. A work position varying mechanism 9 is further provided, which varies a work position of the movement transmitting mechanism 8 for continuously varying a valve lift degree of intake valves 2 and 2.

Figure 7:
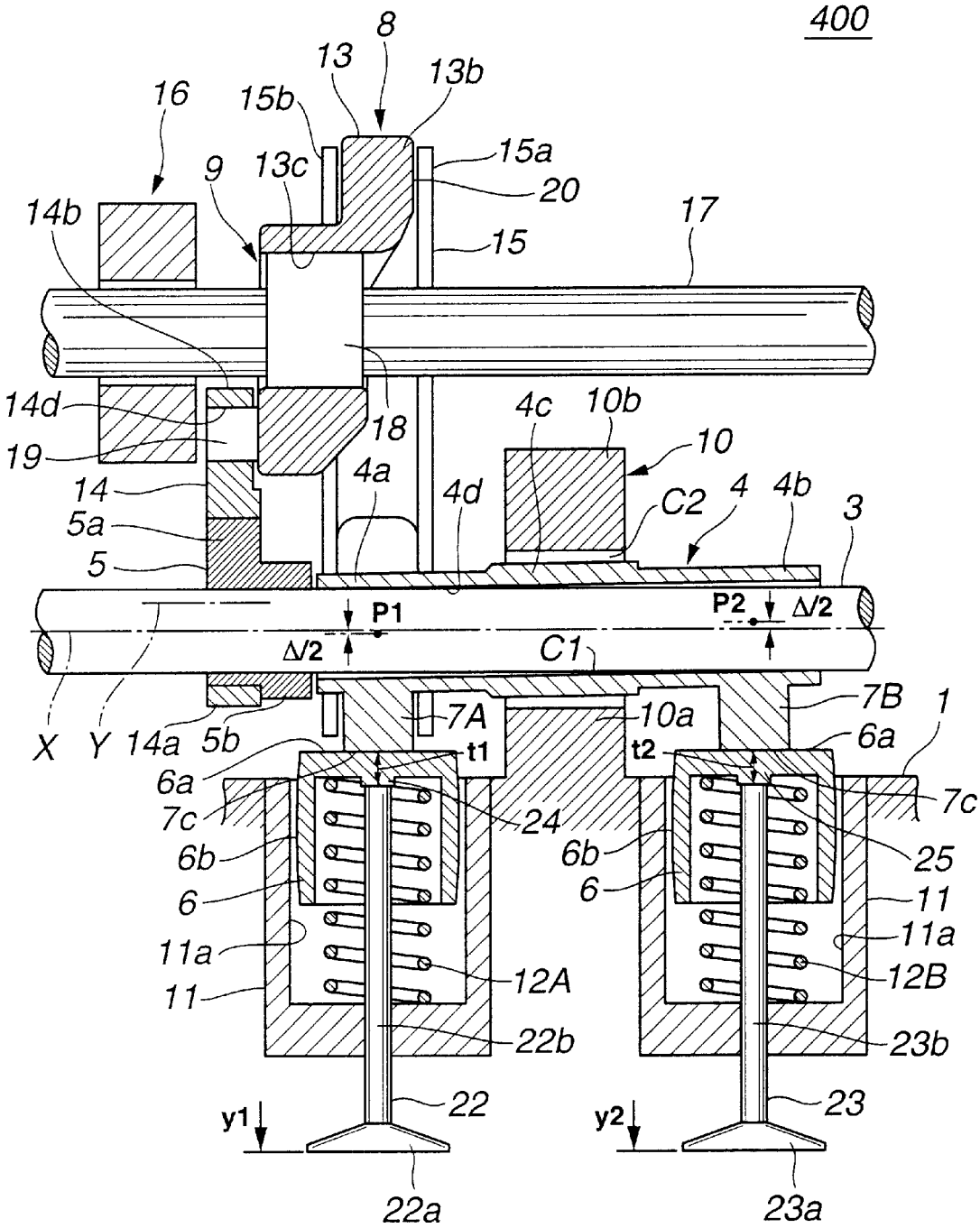
FIG. 7 is a view similar to FIG. 1, but showing a fourth embodiment of the present invention.

As shown in FIGS. 1 and 2, each of intake valves 2 and 2 is biased in a closing direction by a valve spring 12A or 12B that is compressed between a bottom surface of a cylindrical bore member 11 received in the upper end of cylinder head 1 and a lid portion of the valve lifter 6 (see FIG. 7). Hollow drive shaft 3 and drive cam 5 constitutes a drive mechanism.

Drive shaft 3 extends along an axis of the engine and has both end portions rotatably held by bearings (not shown) that are mounted on cylinder head 1. To drive shaft 3, there is transmitted a rotation force (viz., torque) from a crankshaft of the engine through a sprocket (not shown) fixed to an end of drive shaft 3 and a timing chain (not shown) put around the sprocket. Under operation of the engine, drive shaft 3 is rotated in a clockwise direction in FIG. 2.

Cam shaft 4 is formed with an axially extending bore 4*d* through which drive shaft 3 passes. Thus, cam shaft 4 is rotatably supported on cylindrical outer surface 3*a* of drive shaft 3. Cam shaft 4 is formed at a generally middle portion thereof with a larger diameter journal portion 4*c* which is rotatably received by a projected bearing 10 that is integral with cylinder head 1.

As shown in FIG. 1, actually, drive shaft 3 is received in cam shaft 4 with a first cylindrical clearance C1 kept therebetween, and cam shaft 4 is received by the bearing 10 with a second cylindrical clearance C2 kept therebetween.

Preferably, the thickness of first cylindrical clearance C1 is from about 40 $\mu$m to 50 $\mu$m, and the thickness of second cylindrical clearance is about 65 $\mu$m.

It is to be noted that the thickness of first cylindrical clearance C1 is smaller than that of the second cylindrical clearance C2.

As shown, the bearing 10 comprises a bearing base portion 10*a* that is integrally formed on cylinder head 1 and a bearing bracket 10*b* that is connected to the bearing base portion 10*a* by means of two bolts (not shown). The bearing base portion 10*a* and bearing bracket 10*b* have respective semi-circular recesses which are mated to define a cylindrical bore through which the larger diameter journal portion 4*c* of cam shaft 4 passes, as shown.

As is seen from FIGS. 1 and 2, drive cam 5 comprises a generally circular cam proper 5*a* and a tubular portion 5*b* which are integral with each other. As shown in FIG. 1, drive cam 5 is tightly mounted to drive shaft 3 by means of a fixing pin (not shown). Cam proper 5*a* has a cam profile so that a center axis Y thereof is offset or displaced from the rotation axis X of drive shaft 3 by a given distance.

Each of valve lifters 6 and 6 is constructed of an aluminum alloy and shaped like a cylinder member with a lid portion. Each valve lifter 6 is slidably received in a cylindrical bore 11*a* of the corresponding cylindrical bore member 11 mounted on the cylinder head 1. An upper surface 6*a* is shaped flat, to which the corresponding swing cam 7A or 7B contacts.

Each valve lifter 6 is shaped like a barrel having a swelled outer surface 6*b* as shown. Thus, each valve lifter 6 is inclinable in the corresponding cylindrical bore member 11. Although not shown in the drawings, the lid portion of each valve lifter 6 is provided at an inner surface with a reinforced steel shim to which an upper end of valve stem of intake valve 2 contacts.

As is seen from FIG. 2, each swing cam 7A or 7B is shaped like a raindrop and has a base end portion 7*a* tightly disposed on cam shaft 4. Thus, each swing cam 7A or 7B is swingable about the rotation axis X of drive shaft 3. A cam surface 7*c* extends between the base end portion 7*a* and a cam nose portion 7*b*, which has a curved surface, as shown. As is seen from the drawing (viz., FIG. 2), when cam nose portion 7*b* of swing cam 7A or 7B takes a position to contact the upper surface 6*a* of valve lifter 6, the corresponding intake valve 2 is maximally opened against the biasing force of valve spring 12A or 12B.

As is seen from FIGS. 1, 2 and 3, movement transmitting mechanism 8 comprises a rocker arm 13 that is positioned above drive shaft 3, a link arm 14 that pivotally connects an end 13*a* of rocker arm 13 to drive cam 5, and a link rod 15 that pivotally connects the other end 13*b* of rocker arm 13 to swing cam 7A.

Rocker arm 13 has at a generally intermediate portion a bore 13*c* in which an after-mentioned control cam 18 is disposed for swingably supporting rocker arm 13. The end 13*a* of rocker arm 13 is formed with a pin opening through which a pin 19 passes, and the other end 13*b* of rocker arm 13 is formed with a pin opening into which a pin 20 is inserted for connecting an end 15*a* of link rod 15.

As is seen from FIG. 2, link arm 14 comprises a larger annular base portion 14*a* and a radially projected portion 14*b*. An opening 14*c* of larger annular base potion 14*a* is rotatably disposed about circular cam proper 5*a* of drive cam 5. Projected portion 14*b* is formed with a pin opening 14*d* in which the above-mentioned pin 19 is rotatably received.

As is understood from FIG. 1, link rod 15 is of a channel member and as is seen from FIG. 2, link rod 15 is slightly bent at its middle portion. Both ends 15*a* and 15*b* of link rod 15 are pivotally connected to the other end 13*b* of rocker arm 13 and cam nose portion 7*b* of swing cam 7 by means of the pins 20 and 21 respectively.

As is seen from FIGS. 1 and 2, work position varying mechanism 9 comprises a control shaft 17 that is rotatably held by bearings 16 (only one is shown) arranged above drive shaft 3 and a control cam 18 that is fixed to control shaft 17 to serve as a fulcrum of rocker arm 13. Bearings 16 are provided on a frame member mounted on cylinder head 1.

Control shaft 17 extends in parallel with drive shaft 3. Although not shown in the drawings, rotation angle of control shaft 17 is controlled by an electric actuator (viz., DC motor) through a gear mechanism.

Control cam 18 is in the shape of a cylinder, and as is seen from FIG. 2, a center axis P1 of control cam 18 is displaced or offset from a rotation axis P2 of control shaft 17 by a certain distance.

The electric actuator is controlled by a control unit (not shown) in accordance with an operation condition of the associated engine. The control unit comprises a microcomputer which processes various information signals from a crank angle sensor, an air flow meter, an engine cooling water temperature sensor and an angle sensor for control shaft 17, for estimating the operation condition of the engine.

In the following, operation of the valve mechanism 100 of the first embodiment will be described with the aid of the drawings, particularly FIG. 2.

When, upon receiving an information signal from the control unit, valve mechanism 100 is ordered to carry out a lower lift control, the electric actuator turns control shaft 17 in a clockwise direction to a given angular position as shown in FIG. 2. Due to this turning of control shaft 17, control cam 18 fixed to control shaft 17 is turned upward moving a thicker part 18*a* thereof away from drive shaft 3. With this, control cam 18 is angled with its center axis P1 placed at a left upper side of the rotation axis P2 of control shaft 17 as viewed in FIG. 2. That is, the pivot point between the other end 13*b* of rocker arm 13 and the link rod 15 is pivoted upward with respect to drive shaft 3, so that each swing cam 7A or 7B is turned in a clockwise direction in FIG. 2 and takes a relatively flat position where swing cam 7A or 7B contacts the corresponding valve lifter 6 at its thin portion near the base end portion 7*a*.

Accordingly, when, with the swing cams 7A and 7B assuming the relatively flat position, link arm 14 pushes up the end portion 13*a* of rocker arm 13 upon rotation of drive shaft 3, the moved distance of each valve lifter 6, viz., lift degree of intake valve 2 is small.

Accordingly, in this lower lift control, valve lift degree is made small and the open timing of each intake valve 2 is retarded reducing an overlapping with the corresponding exhaust valve. Under this control, improved fuel consumption as well as stable rotation of the engine are both achieved in a low load operation of the engine.

While, when valve mechanism 100 is ordered to carry out a higher lift control, control shaft 17 is turned in a counterclockwise direction by the electric actuator. Accordingly, control cam 18 fixed to control shaft 17 is turned downward moving the thicker part 18*a* thereof toward drive shaft 3. With this, control cam 18 is angled with its center axis P1 placed at a left lower side of the rotation axis P2 of control shaft 17. That is, the pivot point between the other end 13*b* of rocker arm 13 and the link rod 15 is pivoted downward with respect to drive shaft 3, so that each swing cam 7A or 7B is turned in a counterclockwise direction in FIG. 2 and takes a relatively steep position where swing cam 7A contacts the corresponding valve lifter 6 at the cam nose portion 7*b*.

Accordingly, when, with the switch cams 7A and 7B assuming the relatively steep position, link arm 14 pushes up the end portion 13*a* of rocker arm 13 upon rotation of drive shaft 3, the moved distance of each valve lifter 6, viz., lift degree of intake valve 2 is large.

Accordingly, in this higher lift control, valve lift degree is made large. Thus, the valve open timing of each intake valve 2 is advanced and at the same time, the valve close timing of the valve 2 is retarded. Accordingly, air intake effect is increased and thus satisfied power is produced in a high load operation of the engine.

In the following, first cylindrical clearance C1 and second cylindrical clearance C2 will be considered with reference to FIGS. 1 and 4.

As has been mentioned hereinabove, first cylindrical clearance C1 is the clearance defined between the drive shaft 3 and a cylindrical inner surface of the bore of cam shaft 4, and second cylindrical clearance C2 is the clearance defined between larger diameter journal portion 4*c* of cam shaft 4 and a cylindrical inner surface of the bore of projected bearing 10. Furthermore, the thickness of first clearance C1 is made smaller than that of second clearance C2.

Figure 4:
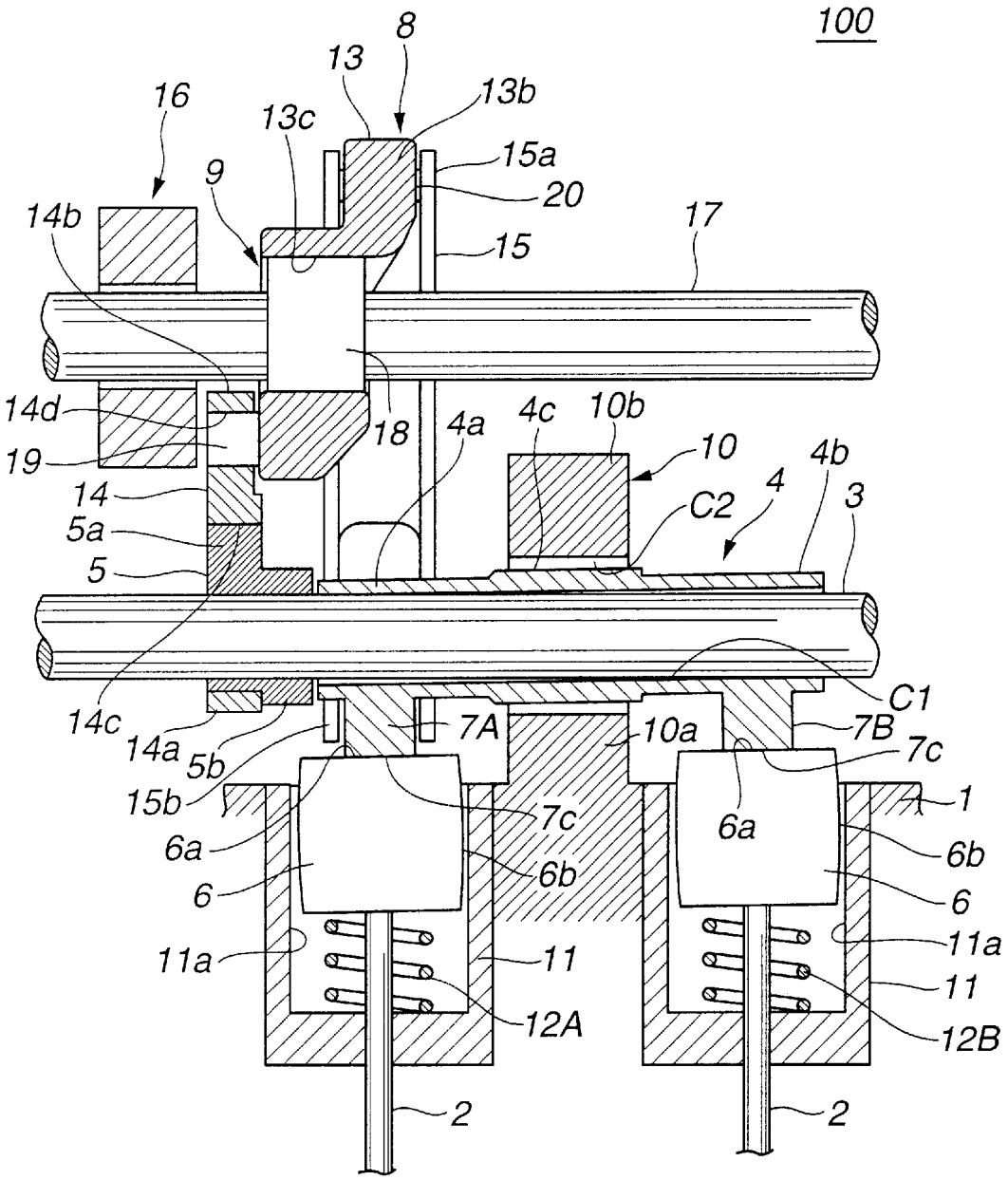
FIG. 4 is a view similar to FIG. 1, but showing a different condition exaggeratedly.

As is exaggeratedly shown in FIG. 4, under a valve opening stage of valve mechanism 100, cam shaft 4 is forced to incline by a certain degree relative to drive shaft 3 because of an unbalanced supporting condition applied to cam shaft 4 wherein a downward force is applied to one end portion 4*a* of cam shaft 4 from drive cam 5 through link arm 14, rocker 13, link rod 15 and one swing cam 7A and an upward force is applied to the other end portion 4*b* of cam shaft 4 by valve spring 12B. However, due to presence of first and second cylindrical clearances C1 and C2, such inclination of cam shaft 4 is appropriately received or absorbed as is seen from the drawing. Thus, undesired uneven wearing of larger diameter journal portion 4*c* of cam shaft 4 and that of the cylindrical surface of the bore of the bearing 10 are suppressed or at least minimized. More specifically, because the thickness of first clearance C1 is smaller than that of second clearance C2, the larger diameter journal portion 4*c* is suppressed from contacting the cylindrical inner surface of the bore of the bearing 10 even if cam shaft 4 is maximally inclined relative to drive shaft 3, as is seen from the drawing.

Furthermore, because of having swelled outer surface 6*b*, each valve lifter 6 is permitted to swing in the cylindrical bore member 11 even when swing cam 7A or 7B fails to properly contact the upper flat surface 6*a* of valve lifter 6 due to the inclination of drive shaft 3. This phenomenon brings about suppression of undesired uneven wearing of the contact portion between swing cam 7A or 7B and the upper surface 6*a* of valve lifter 6.

Upon inclination of each valve lifter 6, the upper end of valve stem slides on the reinforced steel shim provided in valve lifter 6. This suppresses or minimizes wearing of the contact portion between the upper end of the valve stem.

Figure 5:
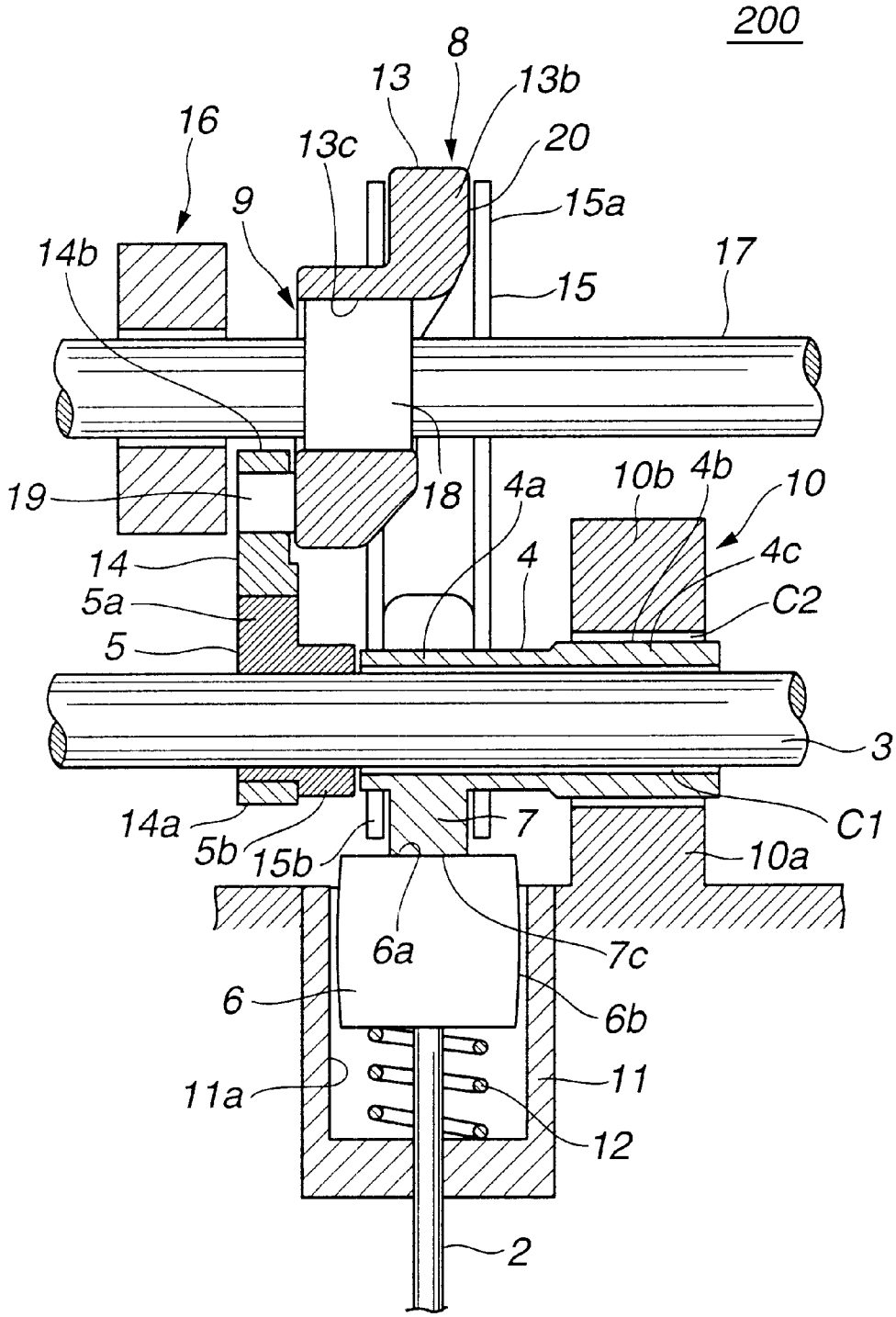
FIG. 5 is a view similar to FIG. 1, but showing a second embodiment of the present invention.

Referring to FIG. 5, there is shown a valve mechanism 200 of a second embodiment of the present invention.

In this second embodiment, valve mechanism 200 is constructed to incorporate with an internal combustion engine of a type having one intake valve for each cylinder. As shown, cam shaft 4 has a length shorter than that in the first embodiment 100, and a swing cam 7 is integrally mounted on one end 4*a* of cam shaft 4. Journal portion 4*c* is formed on the other end 4*b* of cam shaft 4 and received in bearing 10. Like in case of the first embodiment 100, the thickness of first cylindrical clearance C1 is smaller than that of second cylindrical clearance C2.

Accordingly, substantially the same advantages as those of the first embodiment 100 are obtained in this second embodiment 200.

Referring to FIGS. 6, 7, 8 and 9, there are shown valve mechanisms 300, 400, 500 and 600 of third, fourth, fifth and sixth embodiments of the present invention.

Since these embodiments are similar to the above-mentioned first embodiment 100, only portions and parts which are different from those of the first embodiment will be described in detail in the following.

Figure 6:
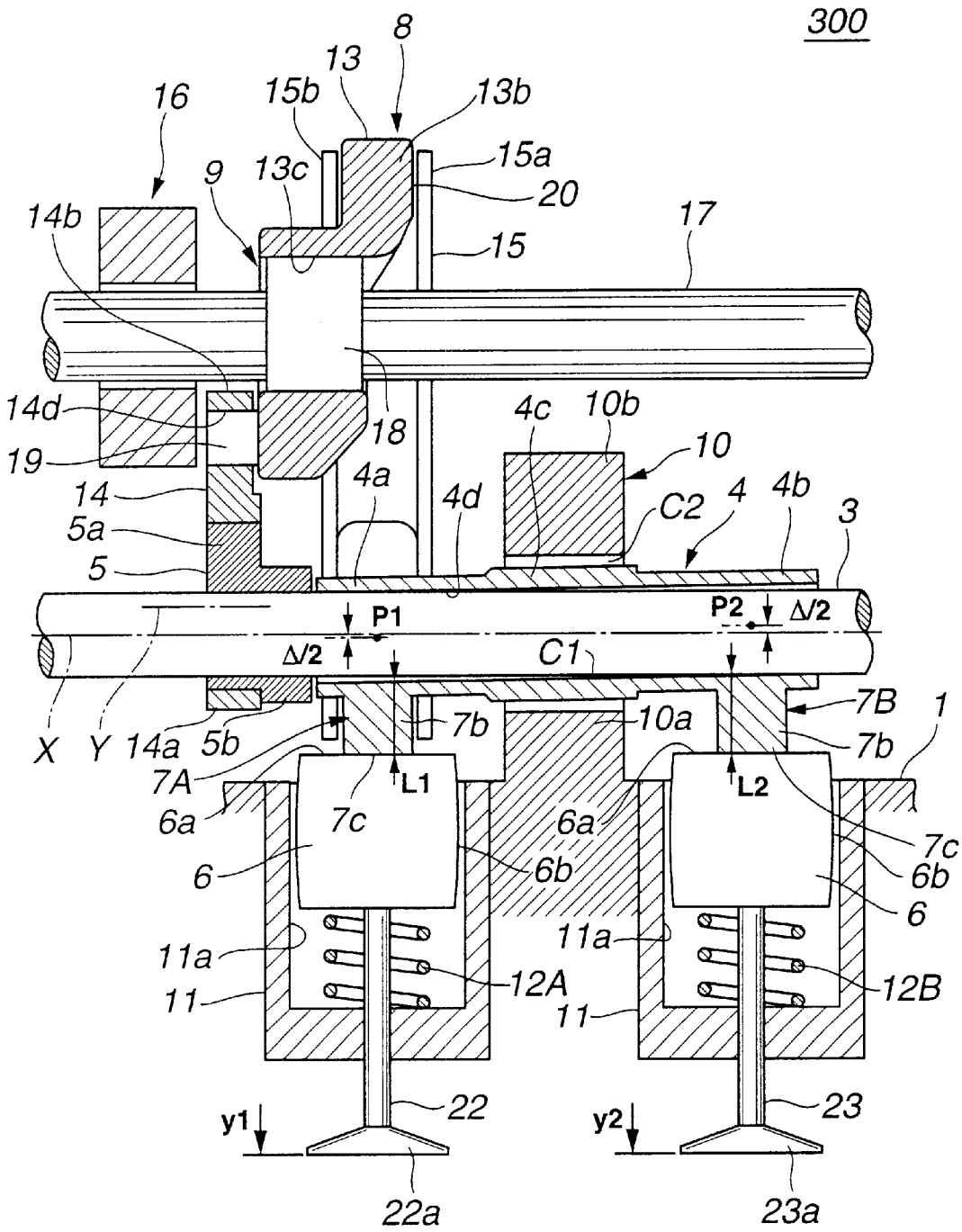
FIG. 6 is a view similar to FIG. 1, but showing a third embodiment of the present invention.

In FIG. 6, there is shown valve mechanism 300 of the third embodiment.

In this third embodiment, the height L2 of the cam nose portion 7*b* of swing cam 7B is greater than the height L1 of the cam nose portion 7*b* of swing cam 7A.

As is seen from FIG. 2, the height L of the cam nose portion 7*b* is the height of a top of the cam nose portion 7*b* from the cylindrical outer surface of cam shaft 4.

Under a valve opening stage of valve mechanism 300, a downward force is applied to one end portion 4*a* of cam shaft 4 and thus first cylindrical clearance C1 permits a diametrically center position P1 of cam shaft 4 at the end portion 4*a* to be shifted downward by a distance of Δ/2. Upon this, a diametrically center position P2 of cam shaft 4 at the other end portion 4*b* is shifted upward by a distance of Δ/2. Thus, the two intake valves 22 and 23 are subjected to a lift difference by an amount of Δ.

In this third embodiment 300, the following equation is established:

$$L2=L1+\Delta \quad (1)$$

This means that the distance y2 from the diametrically center position P2 to a valve head 23*a* is longer than the distance y1 from the diametrically center position P1 to a valve head 22*a* by the distance Δ.

Accordingly, even if cam shaft 4 is inclined for the reason as is described hereinabove, the two valves 22 and 23 are permitted to carry out the same valve operation.

In FIG. 7, there is shown valve mechanism 400 of the fourth embodiment.

In this fourth embodiment, each valve lifter 6 is formed with a projection 24 or 25 against which the top of the corresponding valve stem of intake valve 22 or 23 abuts.

Furthermore, in this fourth embodiment, the following equation is established:

$$t2=t1+\Delta \quad (2)$$

wherein:

t2: the height of projection 25 t1: the height of projection 24

It is to be noted that the height of each projection 24 or 25 is the distance from outer surface 6*a* of the lid portion of valve lifter 6 and the top of the projection 24 or 25, as is shown in the drawing.

Thus, the distance y2 from the diametrically center position P2 to valve head 23*a* is longer than the distance y1 from the diametrically center position P1 to valve head 22*a* by the distance Δ.

Figure 8:
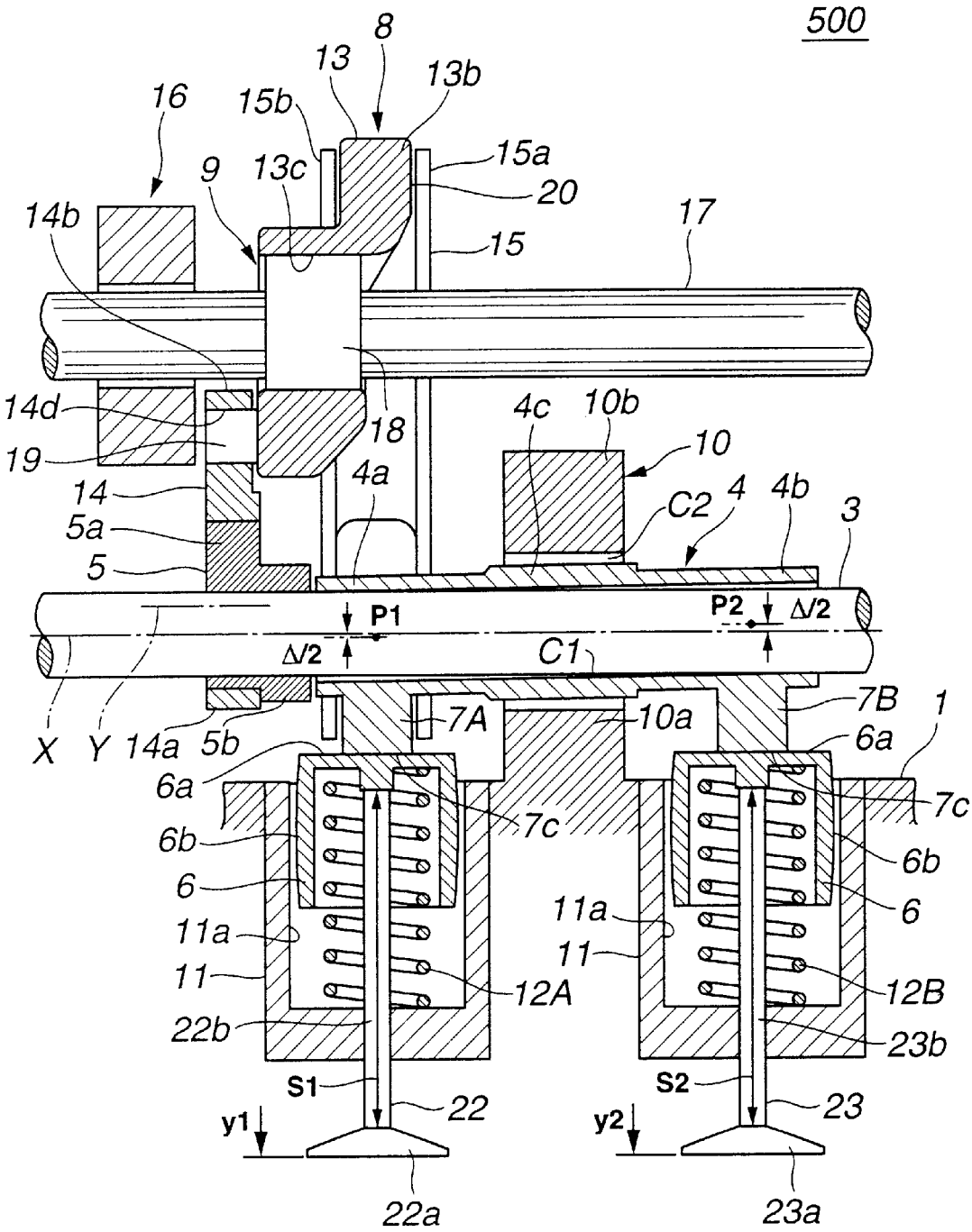
FIG. 8 is a view similar to FIG. 1, but showing a fifth embodiment of the present invention.

In FIG. 8, there is shown valve mechanism 500 of the fifth embodiment.

In this fifth embodiment, the following equation is established:

$$S2=S1+\Delta \quad (3)$$

wherein:

S2: the length of valve stem 23*b*

S1: the length of valve stem 22*b*

Thus, the distance y2 from the diametrically center position P2 to valve head 23*a* is longer than the distance y1 from the diametrically center position P1 to valve head 22*a* by the distance Δ.

Figure 9:
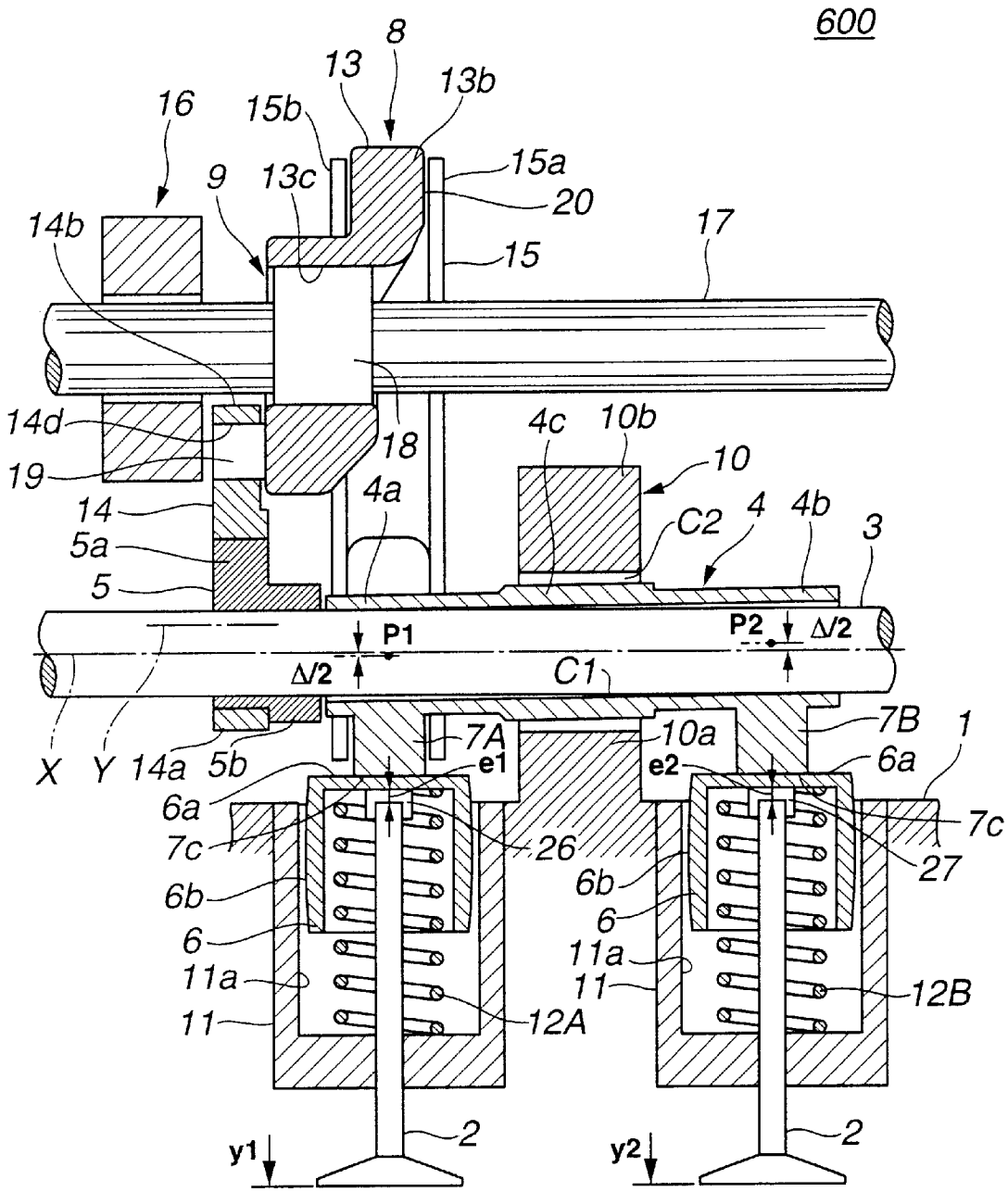
FIG. 9 is a view similar to FIG. 1, but showing a sixth embodiment of the present invention.

In FIG. 9, there is shown valve mechanism 600 of the sixth embodiment.

In this sixth embodiment, the lid portion of each valve lifter 6 is provided with an integral shim 26 or 27. Each shim is formed with a bottomed hole into which the top of valve stem of intake valve 2 is inserted.

Furthermore, in this sixth embodiment, the following equation is established:

$$e2=e1+\Delta \quad (4)$$

wherein:

e2: the thickness of bottom wall of shim 27 e1: the thickness of bottom wall of shim 26

Thus, the distance y2 from the diametrically center position P2 to valve head 23*a* is longer than the distance y1 from the diametrically center position P1 to valve head 22*a* by the distance Δ.

In the present invention, the following advantageous feature is expected.

As is seen from FIG. 1, due to provision of cylindrical clearance C1 defined between drive shaft 3 and cam shaft 4, a certain amount of lubrication oil is reserved in the clearance C1, which serves as a shock absorber against the inclination of cam shaft 4.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve mechanism of an internal combustion engine, comprising:

a drive shaft synchronously rotated with a crankshaft of the engine;

a supporting shaft;

a cylindrical hollow cam shaft rotatably disposed about the supporting shaft keeping a first cylindrical clearance therebetween, the cam shaft being formed with at least one cam that actuates an engine valve for opening and closing the same;

a bearing which bears a given portion of the cam shaft keeping a second cylindrical clearance therebetween; and a movement transmitting mechanism which transmits a torque of the drive shaft to the cam shaft while converting a rotation movement of the drive shaft to a swing movement of the cam shaft, the thickness of the first cylindrical clearance being smaller than that of the second cylindrical clearance.

2. A valve mechanism as claimed in claim 1, in which the supporting shaft is the drive shaft.

3. A valve mechanism as claimed in claim 2, further comprising a work position varying mechanism which varies a work position of the movement transmitting mechanism thereby to continuously vary a valve lift degree of the engine valve.

4. A valve mechanism as claimed in claim 2, further comprising:

a cylindrical bore member having a bore facing the cam of the cam shaft; and a valve lifter slidably received in the cylindrical bore member and connected to the engine valve through a valve stem, the valve lifter being formed with a swelled outer surface so that the valve lifter is inclinable during the sliding movement in the cylindrical bore member.

5. A valve mechanism as claimed in claim 2, in which the thickness of the first cylindrical clearance is from approximately 40 $\mu$m to approximately 50 $\mu$m, and the thickness of the second cylindrical clearance is approximately 65 $\mu$m.

6. A valve mechanism of an internal combustion engine which has two engine valves for each cylinder which are biased in a closing direction by valve springs, the valve mechanism comprising:

a supporting shaft;

a swing member having a through bore, the swing member being swingably disposed on the supporting shaft having the supporting shaft received in the through bore, the swing member operating the engine valves to open against a biasing force of the valve springs when swung; and a drive mechanism that applies a drive force to the swing member to effect the swing movement against the biasing force of the valve springs, the drive mechanism being constructed to apply the drive force to one end portion of the swing member with respect to an axial direction of supporting shaft, wherein, when the engine valves are maximally opened by the swing member, a distance from a second diametrically center position of the through bore of the swing member to a head member of the corresponding engine valve is longer than a distance from a first diametrically center position of the through bore of the swing member to a head member of the corresponding engine valve, the first diametrically center position being in the vicinity of the one end portion of the swing member.

7. A valve mechanism of an internal combustion engine having first and second engine valves for each cylinder, comprising:

a drive shaft rotated synchronously together with a crankshaft of the engine;

a cylindrical hollow cam shaft rotatably disposed about the drive shaft keeping a first cylindrical clearance therebetween, the cam shaft being formed with first and second cams that respectively actuate the first and second engine valves for opening and closing the same;

a bearing which bears a given portion of the cam shaft keeping a second cylindrical clearance therebetween, the given portion being positioned between the first and second cams; and a movement transmitting mechanism which transmits a torque of the drive shaft to the cam shaft while converting a rotation movement of the drive shaft to a swing movement of the cam shaft, the movement transmitting mechanism being arranged to apply the torque to one axial end of the cam shaft where the first cam is provided, wherein the thickness of the first cylindrical clearance is smaller than that of the second cylindrical clearance.

8. A valve mechanism as claimed in claim 7, further comprising:

a first structure which transmits the movement of the first cam to the first engine valve; and a second structure which transmits the movement of the second cam to the second engine valve, wherein, when first and second engine valves are maximally opened by the first and second cams, a distance from a diametrically center position of a cylindrical bore of the cam shaft to a head of the second engine valve through the second structure is longer than a distance from another diametrically center position of the cylindrical bore of the cam shaft to a head of the first engine valve through the first structure.

9. A valve mechanism as claimed in claim 8, in which the thickness of the first cylindrical clearance is smaller than that of the second cylindrical clearance.

10. A valve mechanism as claimed in claim 9, in which the thickness of the first cylindrical clearance is from approximately 40 $\mu$m to approximately 50 $\mu$m, and the thickness of the second cylindrical clearance is approximately 65 $\mu$m.

11. A valve mechanism as claimed in claim 8, in which each of the first and second structures comprises:

a cylindrical bore member having a cylindrical bore directed toward a corresponding one of the first and second cams;

a valve lifter slidably received in the cylindrical bore member, the valve lifter being formed with a swelled outer surface so that the valve lifter is inclinable during the sliding in the cylindrical bore member, the valve lifter having a lid portion to which the corresponding cam contacts; and a valve stem having one end fixed to the valve head and the other end contacting the lid portion of the valve lifter.

12. A valve mechanism as claimed in claim 11, in which a height of a cam nose portion of the second cam is greater than that of the first cam.

13. A valve mechanism as claimed in claim 11, in which the lid portion of the valve lifter associated with the first cam is formed at its inner surface with a first projection to which the top of the valve stem contacts and the lid portion of the other valve lifter associated with the second cam is formed at its inner surface with a second projection to which the top of the other valve stem contacts, wherein a height of the second projection is greater than that of the first projection.

14. A valve mechanism as claimed in claim 11, in which a length of the valve stem of the second engine valve is greater than that of the valve stem of the first engine valve.

15. A valve mechanism as claimed in claim 11, in which the lid portion of the valve lifter associated with the first cam is formed at its inner surface with a first shim having a first bottom wall to which the top of the valve stem contacts, and the lid portion of the other valve lifter associated with the second cam is formed at its inner surface with a second shim having a second bottom wall to which the top of the other valve stem contacts, wherein a thickness of the second bottom wall is greater than that of the first bottom wall.

* * * * *